US010020578B2

(12) United States Patent
Nilsson et al.

(10) Patent No.: US 10,020,578 B2
(45) Date of Patent: Jul. 10, 2018

(54) ANTENNA ARRANGEMENT WITH VARIABLE ANTENNA PATTERN

(71) Applicant: Telefonaktiebolaget LM Ericsson (publ), Stockholm (SE)

(72) Inventors: Andreas Nilsson, Göteborg (SE); Sven Petersson, Sävedalen (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 91 days.

(21) Appl. No.: 15/307,236

(22) PCT Filed: Apr. 28, 2014

(86) PCT No.: PCT/EP2014/058618
§ 371 (c)(1),
(2) Date: Oct. 27, 2016

(87) PCT Pub. No.: WO2015/165489
PCT Pub. Date: Nov. 5, 2015

(65) Prior Publication Data

US 2017/0047654 A1 Feb. 16, 2017

(51) Int. Cl.
*H01Q 3/26* (2006.01)
*H01Q 3/36* (2006.01)
(Continued)

(52) U.S. Cl.
CPC ..... *H01Q 3/2605* (2013.01); *H01Q 1/246* (2013.01); *H01Q 3/36* (2013.01); *H01Q 21/0006* (2013.01); *H01Q 21/08* (2013.01)

(58) Field of Classification Search
CPC .... H01Q 1/246; H01Q 21/0006; H01Q 21/08; H01Q 3/2605; H01Q 3/26; H01Q 3/36
See application file for complete search history.

(56) References Cited

U.S. PATENT DOCUMENTS 3,255,450 A * 6/1966 Butler ..... H01Q 3/40 342/373
3,295,134 A * 12/1966 Lowe ..... H01Q 3/40 333/101

(Continued)

FOREIGN PATENT DOCUMENTS

EP 0313057 A2 4/1989

OTHER PUBLICATIONS

Internatioanl Search Repolrt and Written Opinion dated Dec. 23, 2014 in International application No. PCT/EP2014/058618 dated Dec. 23, 2014, 9 pages.

*Primary Examiner* — Tho G Phan
(74) *Attorney, Agent, or Firm* — Rothwell, Figg, Ernst & Manbeck, p.c.

(57) ABSTRACT

An antenna arrangement comprising an even number E>3 of antenna elements 210, 210', connected to steerable phase shifters 211, and a number C=(E/2)*(E/2+1)/2 of hybrid couplers 212, as well as a number of E antenna arrangement ports 213 configured as an interface to the antenna arrangement. Hybrid coupler ports of a bottommost tier 218 of hybrid couplers 212 are connected to respective antenna arrangement ports 213, and hybrid couplers in an overlaying at least one tier 219 are connected to hybrid couplers in a tier immediately below. Unconnected hybrid coupler ports are connected directly to the first antenna element 210' or to one of the other antenna elements 210.

17 Claims, 14 Drawing Sheets

(51) Int. Cl.

| | |
|---|---|
| ***H01Q 1/24*** | (2006.01) |
| ***H01Q 21/00*** | (2006.01) |
| ***H01Q 21/08*** | (2006.01) |

(56) References Cited

U.S. PATENT DOCUMENTS

| | | | | | |
|---|---|---|---|---|---|
| 3,518,695 | A | * | 6/1970 | Schroeder | H01Q 21/08 342/368 |
| 3,731,316 | A | * | 5/1973 | Sheleg | H01Q 3/40 342/373 |
| 3,740,756 | A | * | 6/1973 | Sosin | H01Q 3/24 330/53 |
| 4,213,132 | A | | 7/1980 | Davidson | |
| 4,839,659 | A | | 6/1989 | Stern et al. | |
| 4,983,988 | A | * | 1/1991 | Franke | H01Q 19/108 343/836 |
| 5,373,299 | A | * | 12/1994 | Ozaki | H01Q 3/40 333/116 |
| 2006/0208944 | A1 | | 9/2006 | Haskell | |

* cited by examiner

ANTENNA ARRANGEMENT WITH VARIABLE ANTENNA PATTERN

CROSS-REFERENCE TO RELATED APPLICATION(S)

This application is a 35 U.S.C. § 371 National Phase Entry Application from PCT/EP2014/058618, filed Apr. 28, 2014, and designating the United States.

TECHNICAL FIELD

The present disclosure relates to an antenna arrangement for a wireless system, and in particular to a multi-antenna element arrangement having a variable antenna pattern.

BACKGROUND

An antenna array is a collection of antenna elements which are collectively used to transmit or to receive one or more wireless signals. An antenna array can be used in an antenna arrangement to achieve a variable antenna pattern. The antenna pattern of an antenna arrangement describes the gain of the antenna arrangement as a function of azimuth and elevation.

An antenna arrangement which has an antenna pattern with a significantly larger gain in one direction compared to other directions is referred to as having a main lobe, or main beam, in the direction with high gain. The width of this main beam is herein referred to as the beamwidth of the antenna arrangement. The beamwidth of an antenna arrangement in an elevation direction is herein referred to as the elevation beamwidth of the antenna arrangement.

All antenna arrangements discussed herein are assumed to be reciprocal, meaning that the antenna pattern of an antenna arrangement is substantially equal for transmission and reception of wireless signals.

Antenna arrangements used, e.g., by base stations in cellular communication networks can implement multiple antenna elements in the elevation domain to achieve a narrow elevation beamwidth. Furthermore, if the output power of individual antenna elements can be varied, it becomes possible to dynamically change this elevation beamwidth by changing the output power of different antenna elements.

At least partly towards this end, the individual antenna elements in some antenna arrays have separate radio units and thus also separate amplifiers connected to the individual antenna elements. That is, each antenna element in the array has its own radio unit and amplifier. This enables altering an elevation beamwidth of the antenna array by reducing the output power of one or more of the antenna elements, which can be achieved by simply lowering the output power of the respective individual antenna element amplifiers.

Other antenna arrays make use of active antenna elements, which active antenna elements comprise respective steerable amplifiers which control the individual output powers of the active antenna elements. By controlling output powers of the different antenna elements in this way, the antenna pattern of the antenna arrangement can be varied.

Of course, attenuators can be used instead of antenna element amplifiers with a similar effect.

Controlling individual antenna element output powers by respective antenna element amplifiers, or attenuators, is herein referred to as amplitude tapering of the antenna arrangement.

A negative effect on the power efficiency and on the total output power of the antenna arrangement can be the result when using antenna arrangements with a plurality of individual amplifiers to control, e.g., elevation beamwidth and/or the direction of a main lobe, by varying individual antenna element amplification or attenuation factors. The reason is that some power amplifiers must reduce their output power in order to change beamwidth, and is thus not contributing maximally to output power. The same happens when individual antenna element attenuators are used to control elevation beamwidth, since output power is lost in the attenuation.

Thus, there is a need for an antenna arrangement with variable antenna pattern and improved power efficiency and total output power.

SUMMARY

An object of the present disclosure is to provide at least antenna arrangements, methods and computer programs which seek to mitigate, alleviate, or eliminate one or more of the above-identified deficiencies in the art and disadvantages singly or in any combination and to provide variable pattern antenna arrangements with improved power efficiency or increased total output power.

This object is obtained by an antenna arrangement comprising an even number E, greater than three, of antenna elements. Each of the antenna elements, except for a first antenna element, is connected to a respective steerable phase shifter. There are also comprised a number C=(E/2)*(E/2+1)/2 of hybrid couplers stacked in E/2 tiers of a pyramid distribution network, wherein a bottommost tier comprises E/2 hybrid couplers and each of at least one overlaying tier comprises one less hybrid coupler than a tier immediately below. Each of the hybrid couplers are configured with first port, second port, third port, and fourth port, each configured to have a single connection. The antenna arrangement also comprises a number of E antenna arrangement ports configured as an interface to the antenna arrangement. The first and second hybrid coupler ports of the bottommost tier of hybrid couplers are connected to a respective antenna arrangement port. Each of the first and second ports of hybrid couplers in the overlaying at least one tier is connected to respective third or fourth ports of hybrid couplers in the tier immediately below, such that each hybrid coupler in the overlaying at least one tier is connected to two different hybrid couplers in the tier immediately below. The remaining unconnected third or fourth hybrid coupler ports are connected directly to the first antenna element or to one of the other antenna elements via the corresponding phase shifter such that each antenna element is connected directly, or indirectly via a phase shifter, to a single hybrid coupler port.

Thus, there is provided an antenna arrangement which offers the possibility of varying the antenna pattern by steering the phases applied by the steerable phase shifters and controlling the phases of an input signal passing the interface to the antenna arrangement, i.e., passing the comprised E antenna arrangement ports.

In particular, there is provided an antenna arrangement which offers the possibility of varying the elevation beamwidth by phase control alone, as opposed to both phase and amplitude control, i.e. by amplitude tapering. Thus, improved power efficiency or increased total output power of the antenna arrangement, or by a network node system using the antenna arrangement, is obtained.

Thus, the object is also obtained by a network node comprising the antenna arrangement of the present teaching.

The power efficiency associated with a network node comprising the antenna arrangement is improved in that no explicit power attenuation, or amplitude tapering, is necessary in connection to the separate antenna elements. This is because the steering of the antenna pattern of the antenna arrangement is by the present teaching achieved by phase control alone, as opposed to both phase and amplitude control.

Also, a network node comprising the antenna arrangement can achieve a high total output power, again due to that no explicit power attenuation is necessary in connection to the antenna elements of the present antenna arrangement.

The object is further obtained by a method in a network node for transmitting radio signals via an antenna arrangement. The method comprises configuring a first antenna element to emit a radio signal with a fixed phase shift, and a number of E−1 steerable phase shift antenna elements to emit respective radio signals having respective phase shifts. The phase shifts are determined by E−1 comprised respective steerable phase shifters. E is even and E is larger than three. The method also comprises configuring a number of C=(E/2)*(E/2+1)/2 hybrid couplers in a pyramid distribution network, arranged between E antenna arrangement ports and the E antenna elements. The distribution network is operable to distribute a radio signal transmitted on the E antenna arrangement ports between antenna elements based on relative signal phase at the antenna ports. The method also comprises receiving a radio signal on the E antenna arrangement ports. The radio signal has a respective and pre-determined signal phase on each of the E antenna arrangement ports.

The object is furthermore obtained by a method in a network node for receiving radio signals via an antenna arrangement. The method comprises configuring a first antenna element to receive and output a radio signal with a fixed phase shift, and also to configure E−1 steerable phase shift antenna elements to receive and output respective radio signals having respective pre-determined phase shifts. The phase shifts are determined by E−1 respective steerable phase shifters. E is even and E is larger than three. The method also comprises configuring a number of C=(E/2)*(E/2+1)/2 hybrid couplers in a pyramid distribution network arranged between E antenna arrangement ports and the E antenna elements. The distribution network is operable to distribute a radio signal received via the E antenna elements between antenna arrangement ports. The method also comprises receiving a radio signal via the E antenna elements to be distributed by the pyramid distribution network between, and output from, the E antenna arrangement ports.

There is also provided a computer program, comprising computer readable code which, when run on a network node, causes the network node to perform the methods disclosed herein.

The computer program and the methods disclosed herein display advantages corresponding to the advantages already described in relation to the antenna arrangement.

BRIEF DESCRIPTION OF THE DRAWINGS

Further objects, features, and advantages of the present disclosure will appear from the following detailed description, wherein some aspects of the disclosure will be described in more detail with reference to the accompanying drawings, in which.

DETAILED DESCRIPTION

Figure 1:
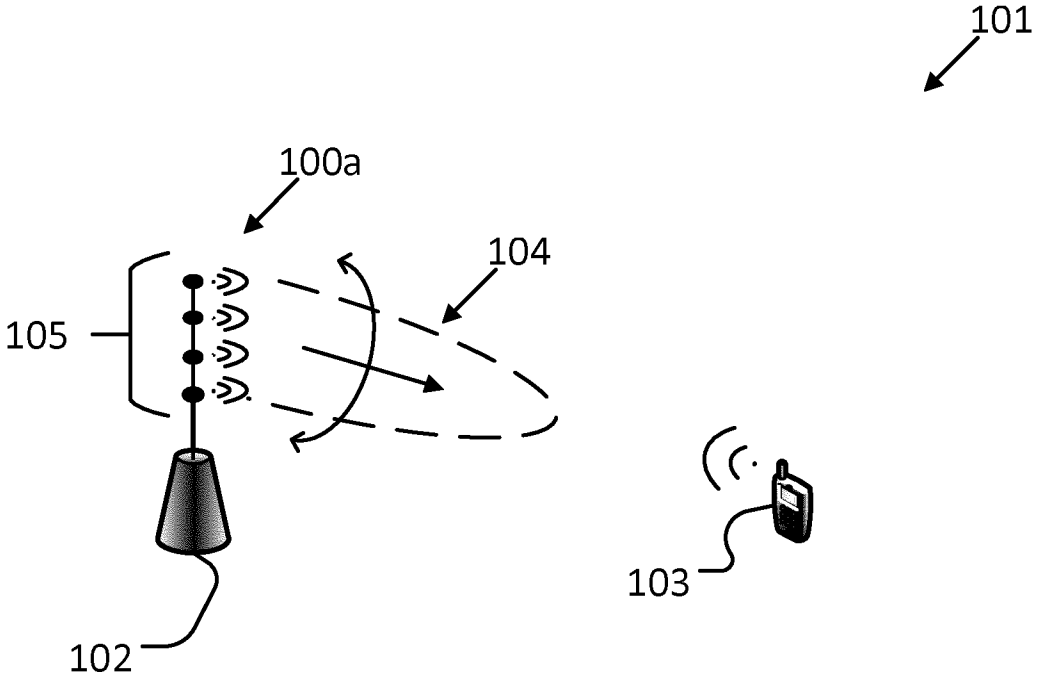
FIG. 1 is a schematic illustration of a radio network.

Aspects of the present disclosure will be described more fully hereinafter with reference to the accompanying drawings. The antenna arrangements, network nodes, methods, and computer programs disclosed herein can, however, be realized in many different forms and should not be construed as being limited to the aspects set forth herein. Like numbers in the drawings refer to like elements throughout, except for a prefix digit in the number which represents the figure in which the element is to be found. Similar objects are differentiated by means of letters. Thus, 100*a* and 200*b* refer to similar objects in FIGS. 1 and 2.

The terminology used herein is for the purpose of describing particular aspects of the disclosure only, and is not intended to limit the invention. As used herein, the singular forms "a", "an" and "the" are intended to include the plural forms as well, unless the context clearly indicates otherwise.

The present teaching relates to an antenna arrangement comprising phase shifters and stacked hybrids that are interconnected in a distribution network between an even number E of antenna elements and the same number E of antenna ports. The disclosed arrangement of stacked hybrids and phase shifters allow an elevation beamwidth and tilt of the antenna arrangement to be changed without affecting the efficiency of one or more power amplifiers connected to the antenna arrangement, or the output power of a network node using the antenna architecture.

Of course, the same concept using stacked hybrids and phase shifters can be applied in an antenna arrangement with variable antenna pattern in azimuth direction, or in both azimuth and elevation direction.

FIG. 1 shows a schematic illustration of a radio network 101 where the present technique is applicable. A network node 102, here shown as a radio base station, RBS, is equipped with an antenna arrangement 100*a* for transmitting and receiving wireless signals to and/or from at least one wireless device 103.

As noted above, by distributing the power of a signal to be transmitted from the antenna arrangement 100*a* in different ways between the antenna elements of the antenna arrangement 100*a*, the beam 104 of the antenna arrangement can be changed in a controlled manner.

For example, if the power is equally distributed between the four antenna elements 105 shown in FIG. 1, a narrow beam can be created by setting proper signal phases at the antenna elements, and if all power is distributed to one antenna element out of the four antenna elements 105 a wide beam can be created. By gradually changing power distribution from distributing the power equally between all antenna elements to putting all power on one antenna element, the beamwidth will gradually change from a narrow beam to a wide beam.

Thus, the elevation beamwidth 104 and potentially also the tilt of the antenna arrangement 100*a* can be varied in order to optimize communication between the network node 102 and the at least one wireless device 103.

As mentioned above, active antennas with distributed radio chains, i.e., where the antenna elements have separate amplifiers connected, have the possibility to change phase and output power individually for each antenna element in an array. In this way, the beamwidth of the antenna arrangement can be changed by changing the output power of different antenna elements. This altering of antenna element output power is referred to as amplitude tapering.

Amplitude tapering can have a negative effect on the power amplifier efficiency and total output power of a network node using the antenna arrangement since some power amplifiers must reduce their output power, or due to that attenuators are put into operation. This effect will be further discussed in connection to FIG. 3 below.

Turning now to FIGS. 2*a-e*, which show aspects of the present teaching. In particular, an antenna arrangement 100*a*, 200*b-f*, comprising an even number E>3 of antenna elements 210, 210', is shown. Each of the antenna elements 210, except for a first antenna element 210', is connected to a respective steerable phase shifter 211.

Figure 2A:
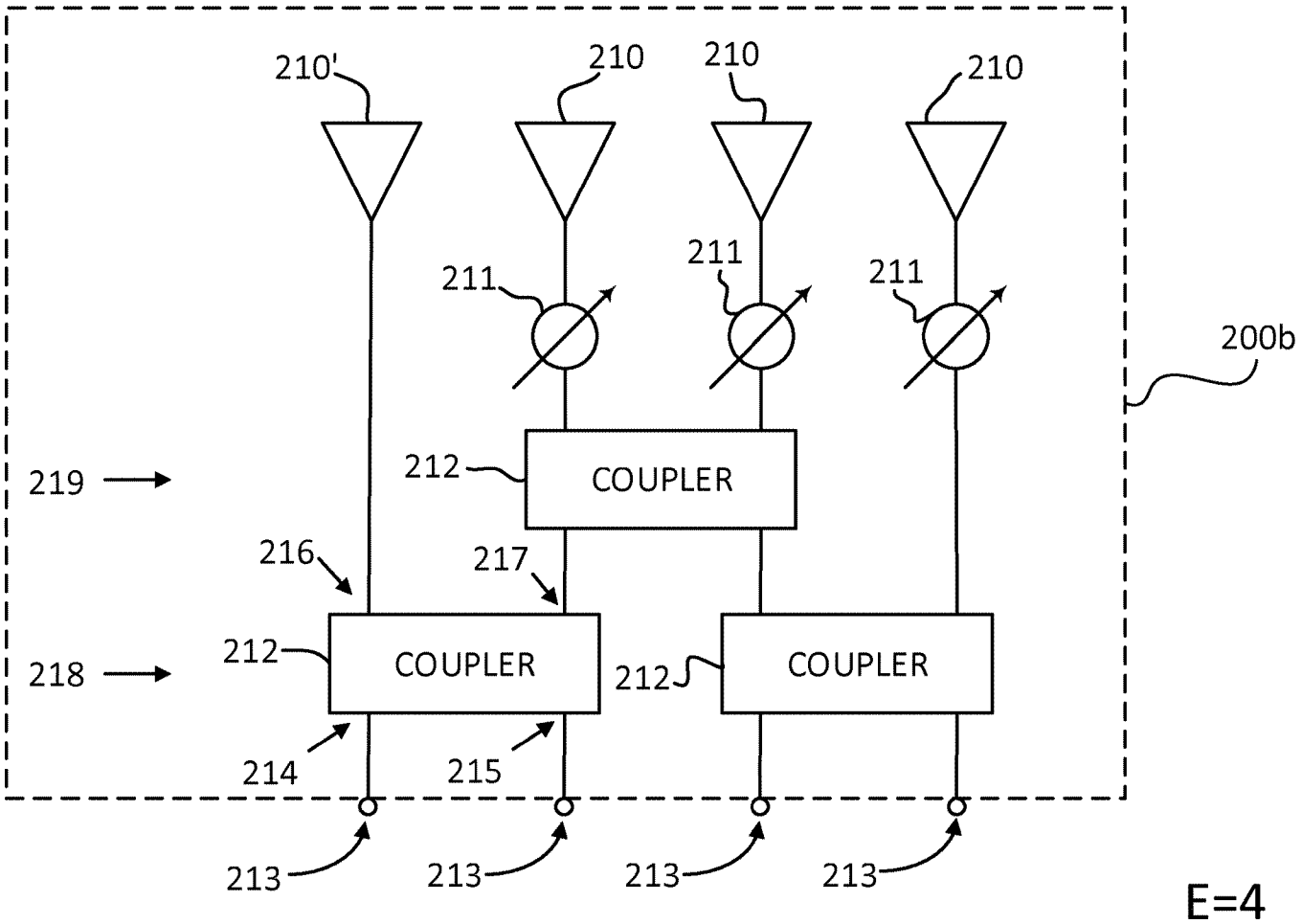
FIGS. 2*a-e* are block diagrams illustrating embodiments of antenna arrangements.
Figure 2C:
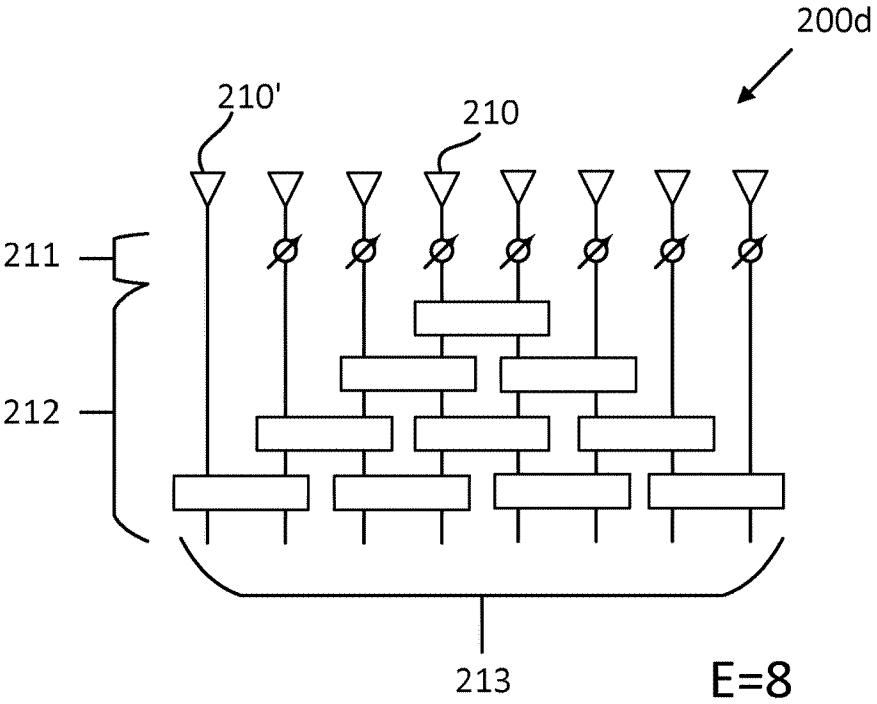
Figure 2B:
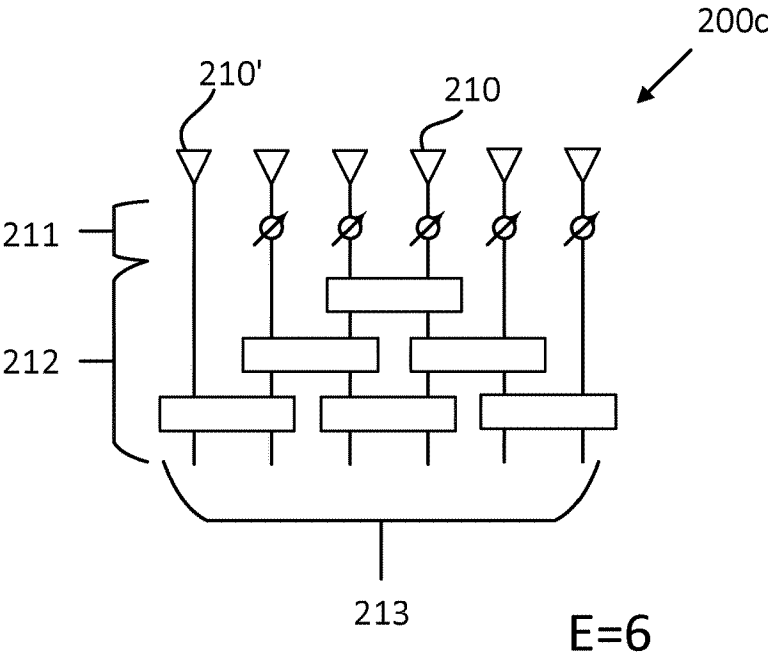
Figure 2E:
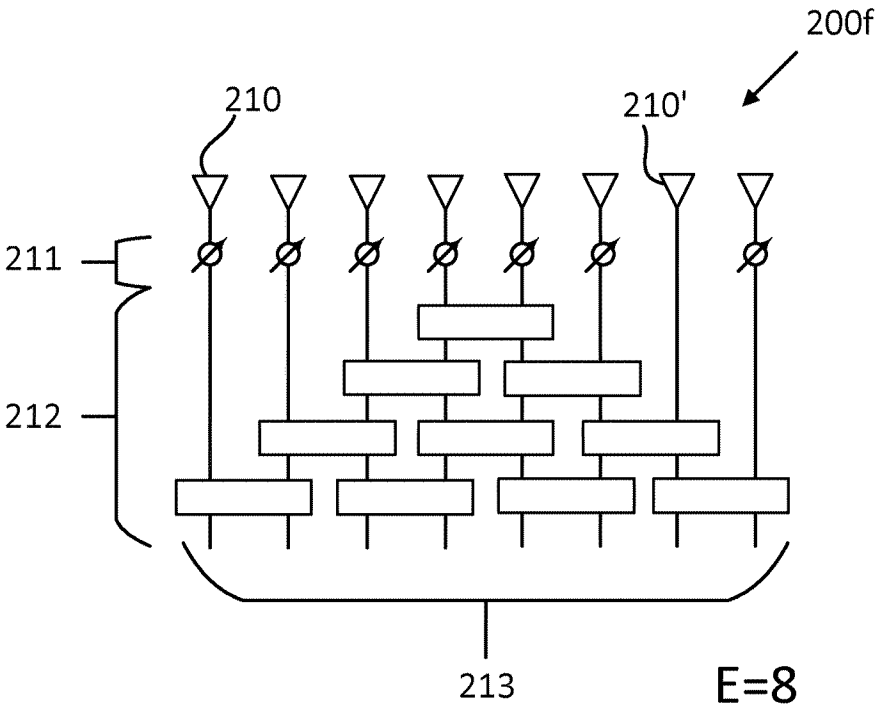
Figure 2D:
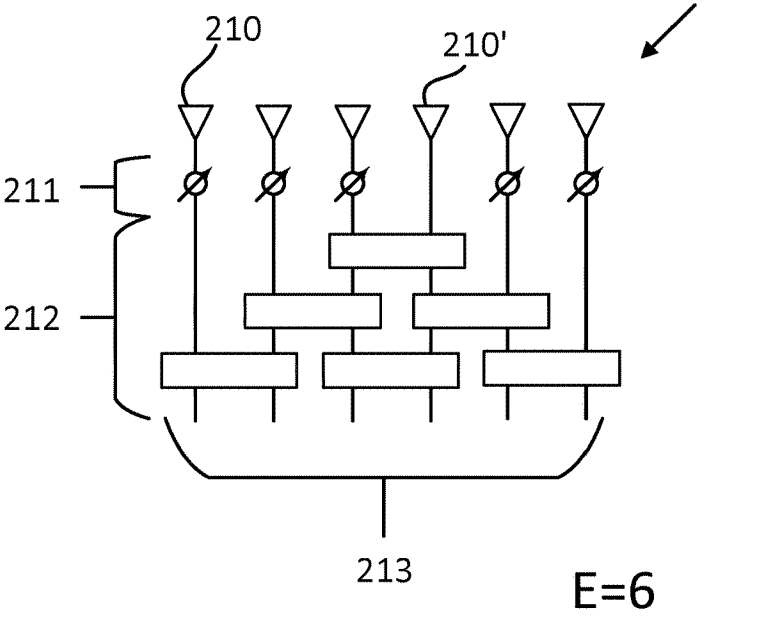

It is noted that any of the E antenna elements 210, 210' may be chosen as the first antenna element 210'; FIGS. 2*a-c* show examples where the leftmost antenna element of the arrangement is chosen as the first antenna element 210', while FIGS. 2*d-e* show examples where the first antenna element is not the leftmost antenna element.

Furthermore, it is observed that full functionality of the antenna arrangement is obtained if all E antenna elements are connected to respective steerable phase shifters, i.e., according to some aspects, each of the antenna elements is connected to a respective steerable phase shifter. In this case, one of the phase shifters, i.e., the steerable phase shifter of antenna element chosen to be the first antenna element can be set at an arbitrary reference phase value.

In some scenarios, especially when E becomes large, i.e., tens or hundreds, the number of steerable phase shifter elements may be reduced to a number below E−1 in order to save cost.

FIGS. 2*a-e* further shows an integer number C=(E/2)*(E/2+1)/2 of hybrid couplers 212 which are stacked in E/2 tiers of a pyramid distribution network, wherein a bottommost tier 218 comprises E/2 hybrid couplers and each of at least one overlaying tier 219 comprises one less hybrid coupler than a tier immediately below. The hybrid couplers 212 will be further discussed in connection to FIG. 4 below.

Thus, herein, when referring to a pyramid distribution network, it is meant the type of stacked hybrid coupler network shown, e.g., in FIGS. 2*a-e*. That is, a number of C=(E/2)*(E/2+1)/2 hybrid couplers connected to each other and stacked in tiers such that the shape of a pyramid results, with E/2 hybrid coupler in a bottommost tier, and a single hybrid coupler in a topmost tier.

This pyramid distribution network is operable to distribute an input signal received on the interface to the antenna arrangement, i.e., the E antenna arrangement ports 213, via the network of hybrid couplers, between the antenna elements based on the respective signal phases of the input signal at the antenna arrangement ports 213. Due to the nature of hybrid couplers, the input signal phases will determine the path the signals take through the distribution network, and thus also which antenna elements will receive the most signal power.

Each of the hybrid couplers 212 are configured with a first 214 port, a second 215 port, a third 216 port, and a fourth 217 port, each configured to have a single connection. Due to the nature of hybrid couplers, the output signals on the third 216 and fourth 217 ports resulting from input signals on the first 214 and second 215 ports are determined by the relative phases and amplitudes of the input signals.

The same is true for reverse operation of the hybrid coupler, i.e., the output signals on the first 214 and second 215 ports resulting from input signals on the third 216 and fourth 217 ports are determined by the relative phases and amplitudes of the input signals.

The hybrid couplers 212 used in the pyramid distribution network can be implemented in a large variety of different techniques and by using a large variety of different architectures.

Thus, according to some aspects, the hybrid couplers 212 comprise 180 degree hybrid couplers.

According to other aspects, the hybrid couplers 212 comprise coupled transmission line architectures.

According to further aspects, the hybrid couplers 212 comprise branch line coupler architectures.

According to other aspects, the hybrid couplers 212 comprise hybrid ring coupler architectures.

The antenna arrangement shown in FIGS. 2*a-e* further comprises a number of E antenna arrangement ports 213 configured as an interface to the antenna arrangement 100*a*, 200*b-f*. The first 214 and second 215 hybrid coupler ports of the bottommost tier 218 of hybrid couplers 212 are connected to a respective antenna arrangement port 213.

Each of the first 214 and second 215 ports of hybrid couplers in the overlaying at least one tier 219 is connected to respective third 216 or fourth 217 ports of hybrid couplers in the tier immediately below, such that each hybrid coupler 212 in the overlaying at least one tier 219 is connected to two different hybrid couplers in the tier immediately below.

Further, all remaining unconnected third 216 or fourth 217 hybrid coupler ports are connected directly to the first antenna element 210' or to one of the other antenna elements 210 via the corresponding phase shifter 211 such that each antenna element is connected directly or indirectly via a phase shifter to a single hybrid coupler port.

Thus a pyramid distribution network is constructed for distributing a signal between the interface to the antenna arrangement, i.e., the E antenna arrangement ports 213, and the E antenna elements 210, 210'.

The antenna architecture of the present disclosure can be used with any antenna array having an even number of antenna elements. FIGS. 2*a-e* illustrate different embodiments of the present technique applied to E=6 and E=8 antenna element arrangements.

As mentioned above, the relative signal phases of the input signal at the antenna arrangement interface, i.e., on the E antenna arrangement ports 213 will determine the power-distribution of signals transmitted from the E antenna elements, and thus also contribute to determine the antenna pattern of the antenna arrangement.

In order to configure the antenna arrangement to have a given antenna pattern, e.g., a given elevation beamwidth, suitable signal phases at the E antenna arrangement ports 213, and suitable phase shifts applied by the steerable phase shifters 211 must be determined in order to generate the wanted antenna pattern.

This determining of signal phases at the E antenna arrangement ports 213, and the phase shifts applied by the steerable phase shifters 211 can be determined in a variety of different ways as will now be outlined.

One such way is by straight forward manual experimentation in lab, i.e., by implementing the described antenna arrangement together with suitable test equipment, and then stepping through a range of signal phases at the E antenna arrangement ports 213, and phase shifts applied by the steerable phase shifters 211, while measuring the resulting antenna pattern corresponding to each applied parameter vector. A list of measured antenna patterns with corresponding phase steering vectors is thus generated. Now, in order to generate a given antenna pattern from the list of antenna patterns, the corresponding parameter vector should be applied.

Another such way is to determine the signal phases at the E antenna arrangement ports 213, and the phase shifts applied by the steerable phase shifters 211, corresponding to a list of antenna patterns by computer simulation. A model of the comprised antenna arrangement components are then used in a computer simulation, wherein a simulated antenna pattern is generated for a given range of signal phases at the E antenna arrangement ports 213, and phase shifts applied by the steerable phase shifters 211. A list of simulated antenna patterns with corresponding phase steering vectors is thus generated. Now, in order to generate a given antenna pattern from the list of antenna patterns, one simply applies the corresponding parameter vector in the list.

Yet another way is to perform theoretical calculations based on the physical properties of the comprised components, i.e., the antenna elements 210, 210', the steerable phase shifters 211, the components 212 of the pyramid distribution network, and the properties of the antenna arrangement interface 213.

Figure 3:
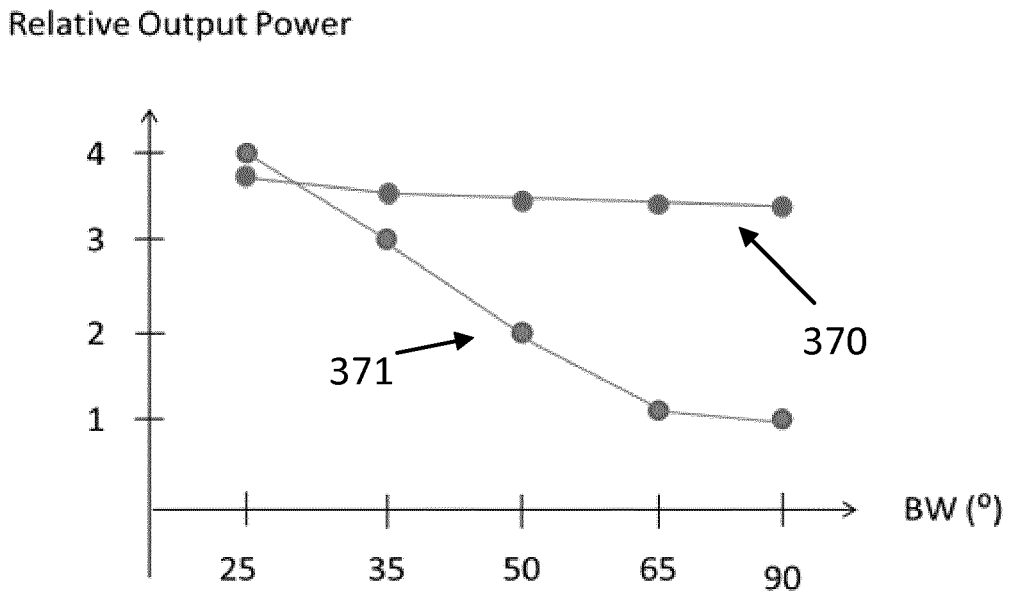
FIG. 3 shows graphs of relative output power as function of elevation beamwidth in degrees.

Turning now to FIG. 3, where a graph of relative output power is shown as function of beamwidth in degrees, used here to provide an example of the benefits of the present teaching. As mentioned above, using antenna arrangements with a plurality of amplifiers to control e.g., to change elevation beamwidth and/or the direction of a main lobe, can have a negative effect on the power efficiency and the total output power of the antenna arrangement. The reason is that some power amplifiers must reduce their output power. This can be the case when using active antenna elements in an array, and also when using separate radio units for the antenna elements in an array. This effect can be seen in FIG. 3, which shows total relative output power 371 for different beamwidths for an antenna arrangement which achieves varying antenna pattern by amplitude tapering. The total relative output power 370 when using an antenna arrangement according to the present teaching of using stacked hybrids and phase shifters is seen to decline much slower with beamwidth.

The extra losses for using the hybrids and phase shifters of the present technique, compared to using amplitude tapering, are taken into account in FIG. 3. The loss of phase shifters are here assumed to be 0.2 dB and for hybrids 0.1 dB. As can be seen in FIG. 3, the total output power when using the present technique is higher than for the antenna architecture based on amplitude tapering for most cases, i.e., for most beamwidths.

Figure 4:
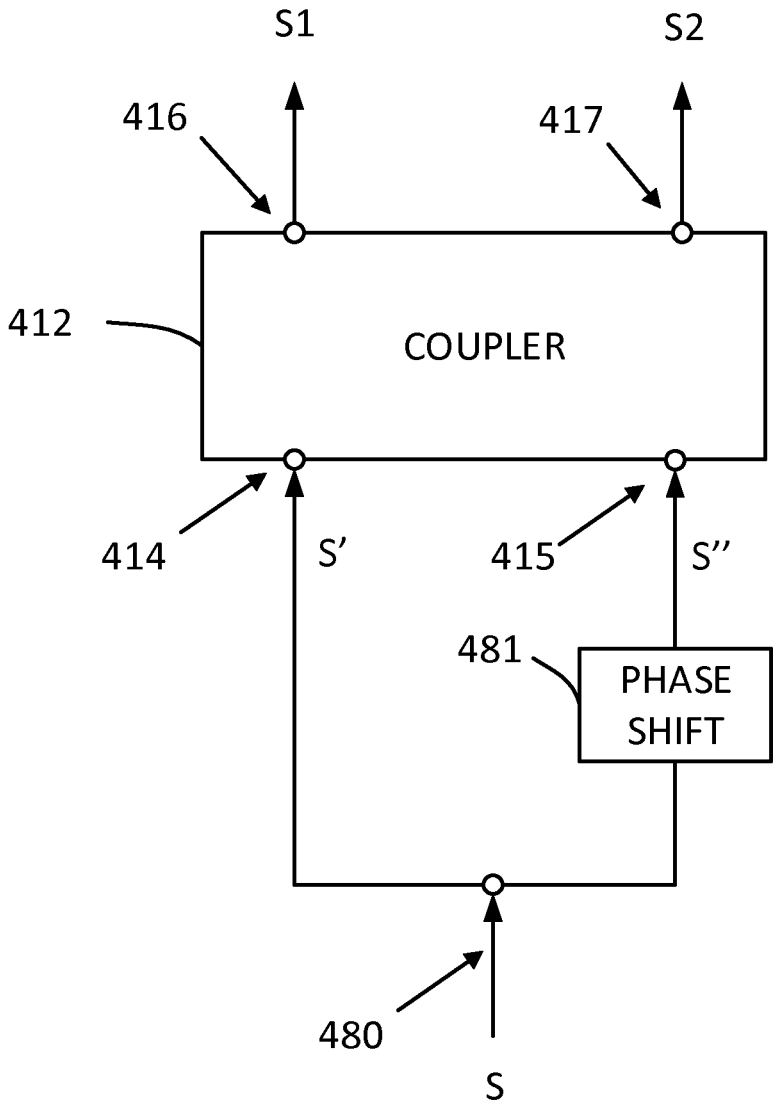
FIG. 4 shows a block diagram of a hybrid coupler.

FIG. 4 shows a hybrid coupler 412. The hybrid coupler 412 is configured with a first port 414, a second port 415, a third port 416, and a fourth port 417, each configured to have a single connection. Herein, having a single connection means that each of the ports of the hybrid coupler 412 is only connected to a single other port, i.e., there is no branching of signals input or output from the four hybrid coupler ports 414-417.

As mentioned above, the hybrid coupler 412 can be implemented in a number of different ways, and by a number of different architectures. Some examples include a 180 degree hybrid coupler implementation, coupled transmission line architecture, branch line coupler architecture, and hybrid ring coupler architecture.

The hybrid coupler 412 shown in FIG. 4 is used in transmit antenna mode, i.e., it is shown to receive signals S' and S" on the first 414 and second 415 ports, and to output signals S1 and S2 on the third 416 and fourth 417 ports, respectively. The reverse operation is of course also possible, i.e., outputting signals on the first 414 and second 415 ports, and receiving signals on the third 416 and fourth 417 ports. This is because the hybrid coupler is a linear and therefore also a reciprocal component.

Now, suppose a given signal S 480 is input with equal amplitude to the first 414 and to the second 415 port of the hybrid coupler 412, but with a relative phase shift 481 on one of the inputs S" compared to the other S'. I.e. S' and S" are the same signal except for a relative phase shift. A common trait of all hybrid coupler implementations disclosed herein is that the relative phase of input signals S', S" to the hybrid coupler 412, i.e., the phase difference between S' and S" determines the relative output powers of the signals 51 on the third 416 and S2 on the fourth 417 port of the hybrid coupler 412.

It is further observed that the relative amplitudes of the input signals S', S", to the hybrid coupler 412 will affect the output distribution. Thus, in general, both amplitude and phase of the input signals will determine the output signals on the third 416 and fourth 417 ports of the hybrid coupler 412.

Figure 5:
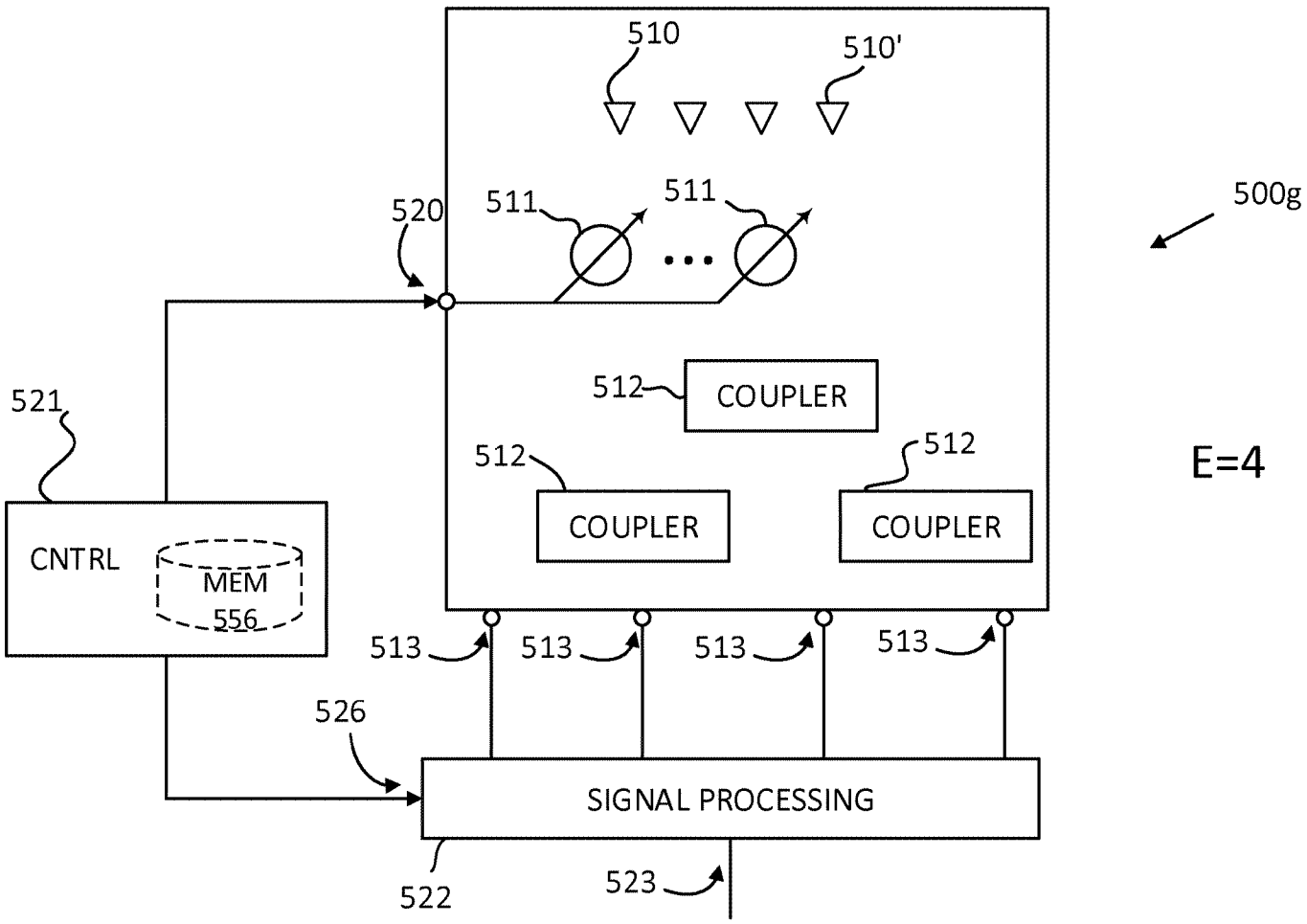
FIGS. 5-6 are block diagrams illustrating embodiments of antenna arrangements.

FIG. 5 illustrates some aspects of the present antenna arrangement 500*g*. This antenna arrangement further comprises a phase steering input port 520 configured to receive a first control signal arranged to individually steer the phases of the steerable phase shifters 511.

According to some aspects, the antenna arrangement 500*g* also comprises a signal processing unit 522 which has a main port 523 configured to pass a main antenna signal, and a control port 526 configured to receive a second control signal.

The signal processing unit 522 is arranged to pass the main antenna signal to each of the E antenna arrangement ports 513 with individual phase shifts determined by the second control signal.

Consequently, FIG. 5 illustrates an embodiment of the present technique. Three hybrid couplers 212 have been connected to each other such that the aggregate signal power received on the antenna arrangement interface 513 is distributed between the E=4 antenna elements without affecting the power amplifier efficiency. The power distribution between the antenna elements is here varied by digitally changing the phase of the signals at each of the antenna arrangement interface ports 513. The steerable phase shifters 511 at the antenna elements are used to tilt the antenna pattern and to compensate for the phase shift applied at the antenna ports. The possible power distributions at respective antenna element, without taking losses into account, can be seen in Table 1 below for the assumption of 1 W power per power amplifier, i.e., per antenna arrangement interface port. One obvious restriction in Table 1 is that the total output power cannot be larger than 4 W, i.e., the sum of power on the antenna arrangement interface ports 513. All different power distribution combinations of Table 1 are not possible, due to the nature of the hybrid couplers, and the connection of hybrid couplers in the pyramid distribution network. However, it is possible to create beams with a large variation in beamwidth.

TABLE 1

Possible output power per antenna element for 1 W power per amplifier of the antenna architecture seen in FIG. 5.

| | Antenna 1 | Antenna 2 | Antenna 3 | Antenna 4 |
|---|---|---|---|---|
| Possible output power | [0-2] W | [0-4] W | [0-4] W | [0-2] W |

Along the same line of reasoning, FIGS. 2*b* and 2*d* which were discussed above illustrate an example embodiment of the present teaching where six hybrids have been connected to each other such that the power received on the antenna arrangement interface ports 213 can be distributed between the six antenna elements 210, 210' in the same way as was discussed in connection to FIG. 2*a*. The possible power distributions at respective antenna element can be seen in Table 2 below. It is assumed that the output power of each power amplifier is 1 W. This embodiment could also be used to create beams with a large variation in beamwidths with reducing the power amplifier efficiency.

TABLE 2

Possible output power per antenna for 1 W power per amplifier of the antenna architecture seen in FIGS. 2b and 2d.

| | Antenna 1 | Antenna 2 | Antenna 3 | Antenna 4 | Antenna 5 | Antenna 6 |
|---|---|---|---|---|---|---|
| Possible output power | [0-2] W | [0-4] W | [0-6] W | [0-6] W | [0-4] W | [0-2] W |

Figure 6:
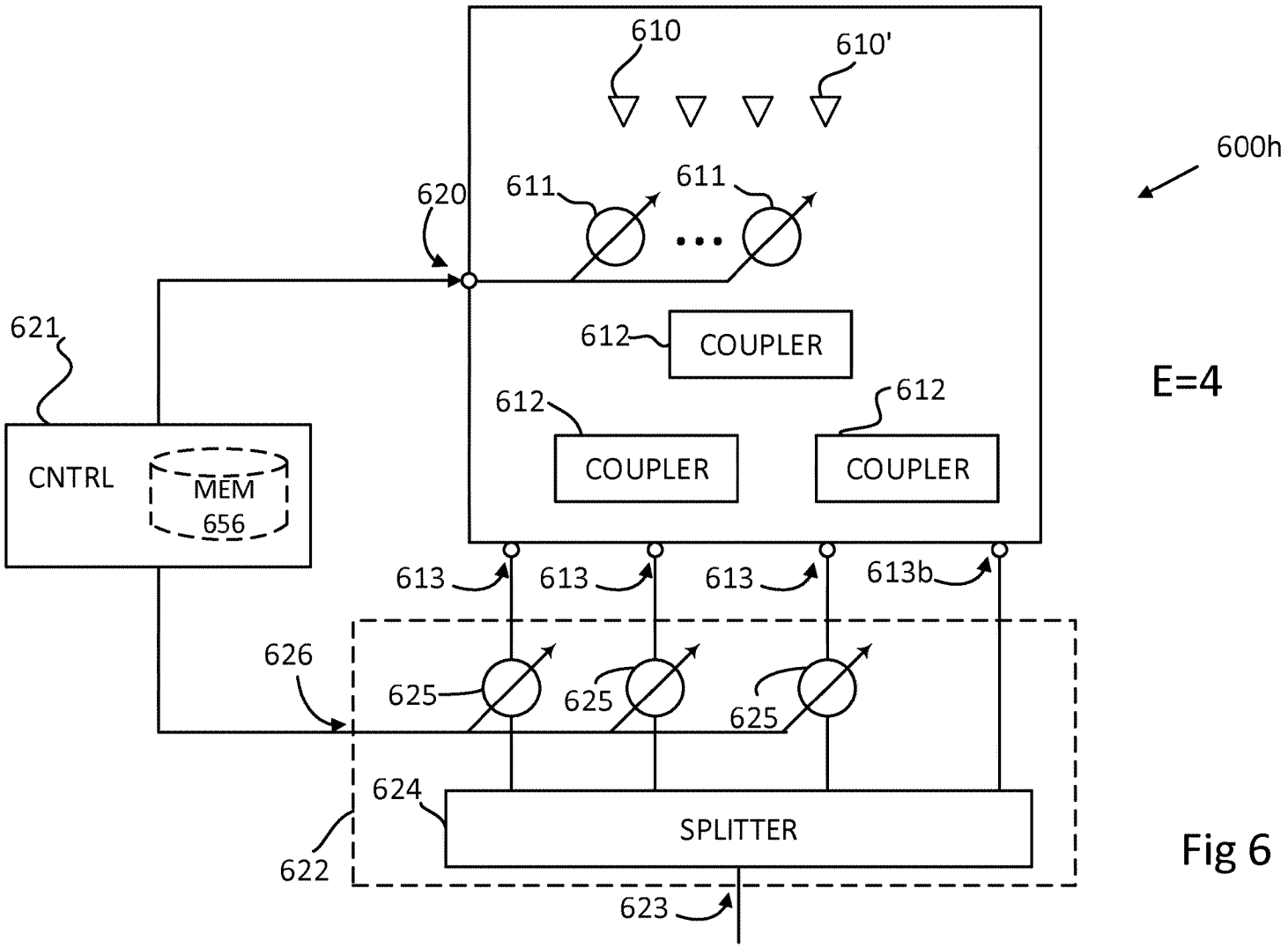

FIG. 6 shows an antenna arrangement 600*h*, wherein the signal processing unit 622 comprises a number of E−1 steerable phase shifters 625, each connected to a respective antenna arrangement port 613. The steerable phase shifters 625 are arranged to be individually steered by the second control signal.

The antenna arrangement 600*h* also comprises a signal splitter 624 arranged to distribute the main antenna signal between the main port 623 and E−1 antenna arrangement ports 613 via the steerable phase shifters 625, and also between the main port 623 and a first antenna arrangement port 613*b* having no associated steerable phase shifter 625.

The example embodiment shown in FIG. 6 is designed for use with one single radio chain, or power amplifier. In this case only analog components are used to create the variable beamwidths and pointing directions of the antenna array 600*h*. One advantage with this particular example embodiment is that it is cheaper because only one radio chain is needed instead of four. One negative part however, is that there will be more losses in the architecture due to extra splitter and phase shifters.

The antenna arrangement 600*h* shown in FIG. 6 further comprises a control unit 621 configured to generate the first and the second control signal from at least one pre-configured antenna pattern having pre-determined corresponding first and second control signals.

The control unit 621 is arranged to pass the generated first and second control signals to the phase steering input port 520 and to the control port 526 of the signal processing unit 522, respectively.

As was discussed above, there are at least three different ways to determine suitable first and second control signals, i.e., by lab experimentation, by computer simulation, or by theoretical calculations.

Furthermore, the control unit 621, according to some aspects, comprises a memory module 656 configured to store list of at least one selectable antenna pattern, each of the at least one selectable antenna pattern having an associated first and second control signal stored in the memory module 656.

Thus, a user of the antenna arrangement can easily set a given antenna pattern by selecting the wanted antenna pattern from the list of selectable antenna patterns, whereupon suitable first and second control signal is generated to actuate phase steering into the desired antenna pattern.

Figure 7:
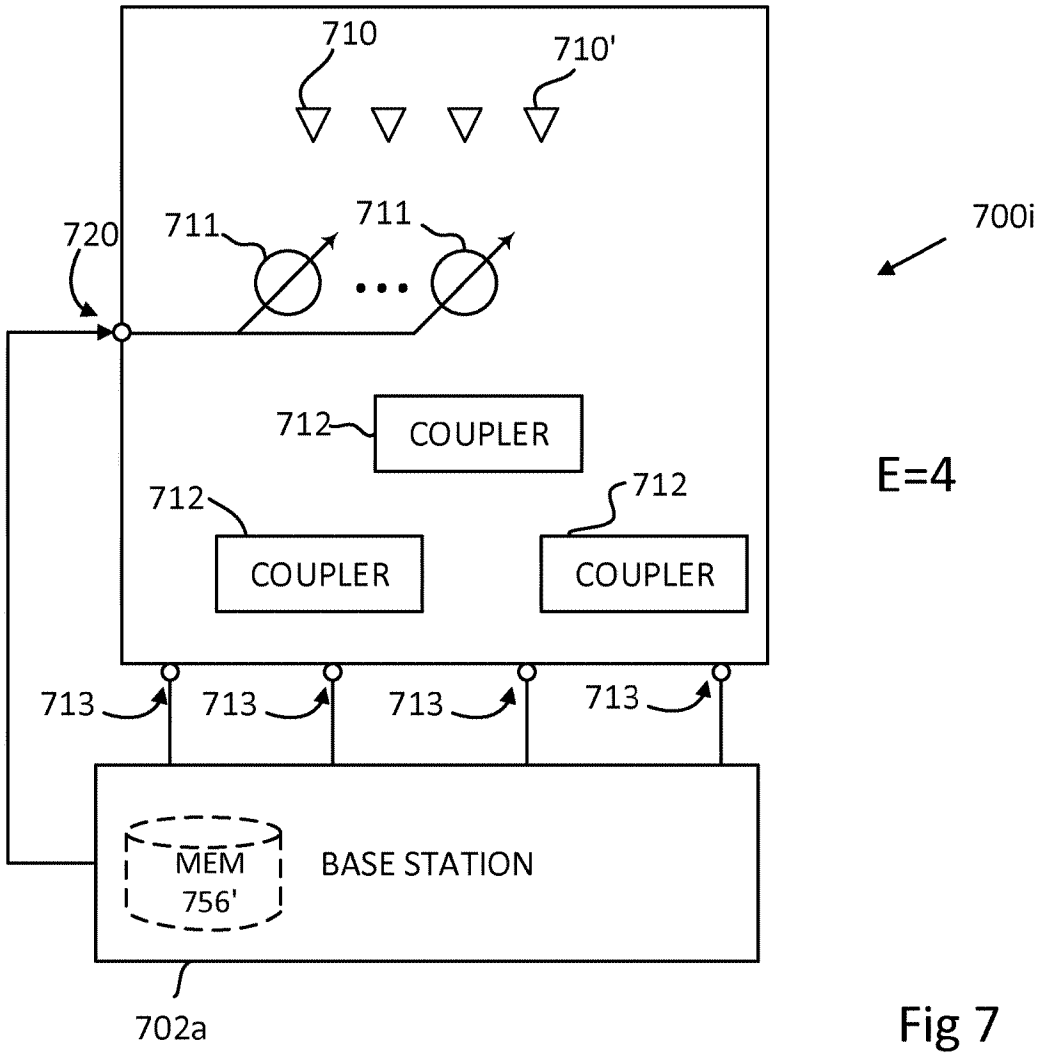
FIGS. 7-8 are block diagrams illustrating embodiments of network nodes.
Figure 8:
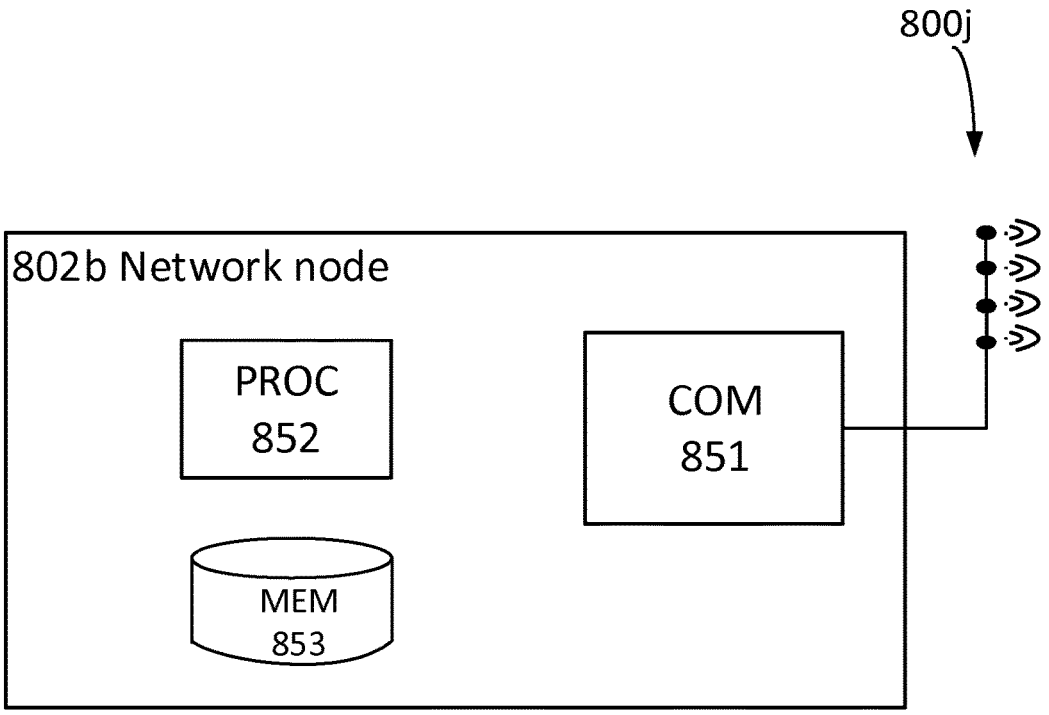

FIG. 7 shows an antenna arrangement 700*i* which further comprises a base station unit 702*a* arranged to transmit radio signals via the E antenna arrangement ports 713. Each such transmitted radio signal is an envelope replica of a common transmit signal, and each such transmitted radio signal has a pre-determined individual phase.

The envelope of a signal describes its amplitude. An envelope replica of a given signal is herein a signal with substantially the same amplitude, but potentially with a different phase.

The base station unit 702*a* is further arranged to generate the first control signal, and to pass the first control signal to the phase steering input port 720 for steering of the steerable phase shifters 711.

Furthermore, the base station unit 702*a* comprises a memory module 756' having a stored list of at least one selectable antenna pattern, each of the at least one selectable antenna pattern having an associated first control signal stored in the memory module 756', and also a corresponding pre-determined phase for each of the transmitted radio signals.

Figures 9A, 9B:
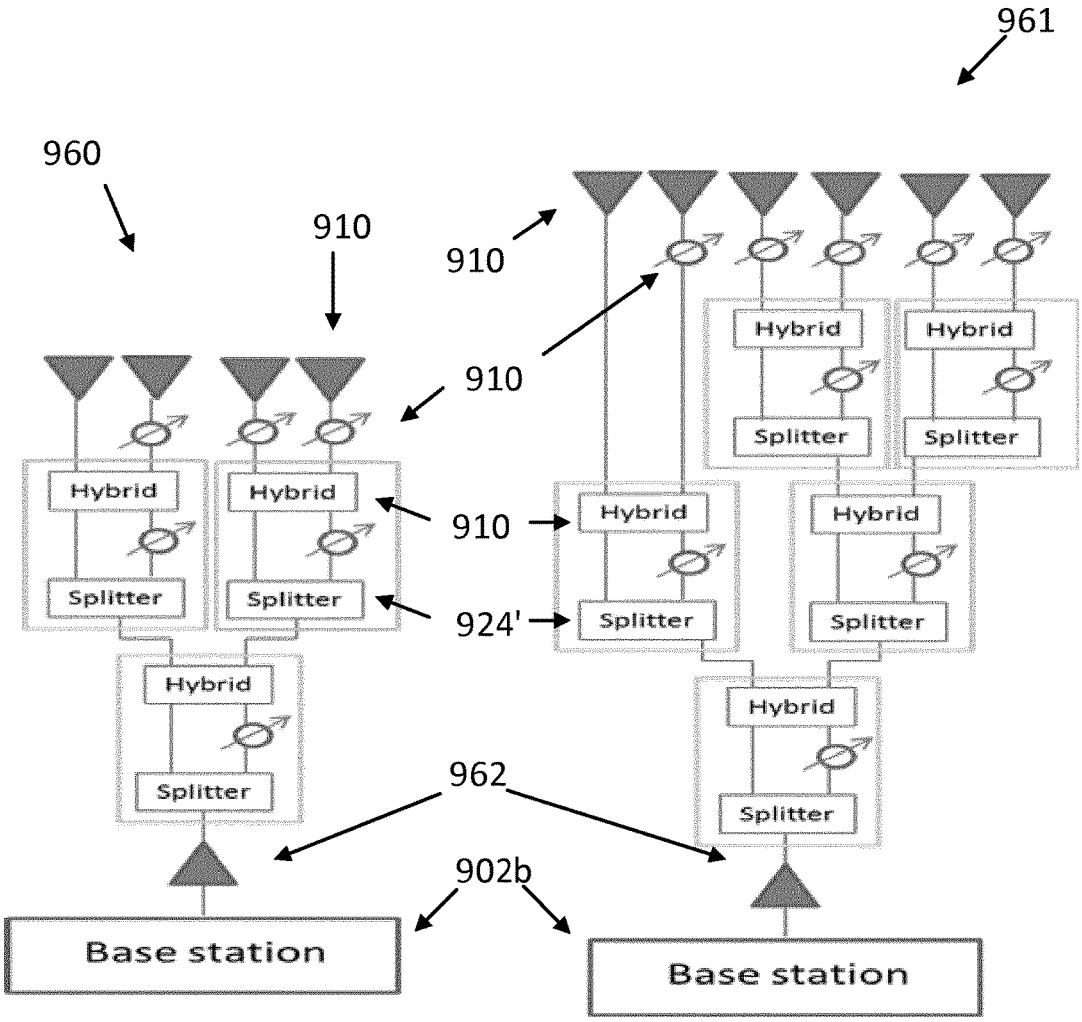
FIGS. 9*a-b* show block diagrams illustrating embodiments of antenna arrangements.

FIGS. 9*a* and 9*b* show an alternative solution for a single power amplifier architecture antenna arrangement. The antenna arrangements 960, 961 shown in FIGS. 9*a* and 9*b* have variable beamwidths and also variable main beam directions. The beamwidth and main beam direction can be changed without affecting the maximum output power of the antenna arrangement. The example is shown for 4 antennas and 6 antennas, respectively, but could be used for an arbitrarily number of antennas. This kind of solution requires more components than the antenna arrangements discussed in connection to FIGS. 2*a-e*, 5, 6, and 7, and is therefore associated with larger losses compared to previously discussed antenna arrangements. For example, the 4 antenna solution seen in FIG. 9*a* has about 0.5 dB extra losses on average compared to the solution seen in FIG. 2*a*, when it is assumed that hybrids/splitters have 0.1 dB losses and phase shifters have 0.2 dB losses.

Figure 10:
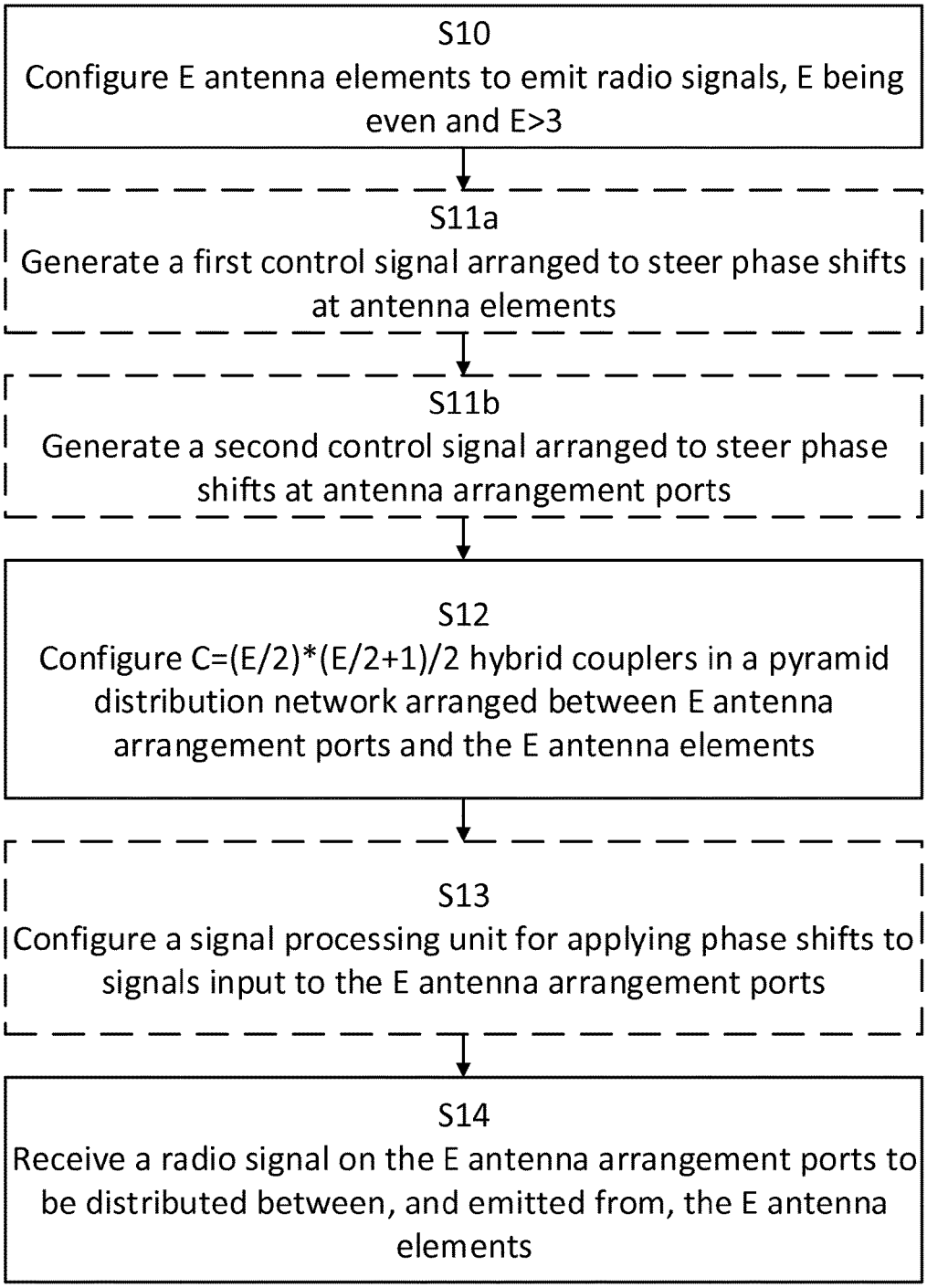
FIGS. 10-11 are flowcharts illustrating embodiments of method steps.

FIG. 10 shows a flowchart illustrating a method in a network node 102 for transmitting radio signals via an antenna arrangement 100*a*, 200*b-f*. The method comprises configuring S10 a first antenna element 210' to emit a radio signal with a fixed phase shift, and a number of E−1 steerable phase shift antenna elements 210 to emit respective radio signals having respective phase shifts. The phase shifts being determined by E−1 respective steerable phase shifters 211,511, and E being even and E>3.

The method also comprises configuring S12 a number of C=(E/2)*(E/2+1)/2 hybrid couplers 212 in a pyramid distribution network arranged between E antenna arrangement ports 213 and the E antenna elements 210', 210. The distribution network is operable to distribute a radio signal transmitted on the E antenna arrangement ports 213 between antenna elements 210', 210 based on relative signal phase at the antenna ports 213.

The method further comprises receiving S14 a radio signal on the E antenna arrangement ports 213. The radio signal has a respective and pre-determined signal phase on each of the E antenna arrangement ports.

The power efficiency associated with a network node implementing the method of FIG. 10 is improved in that no explicit power attenuation, or amplitude tapering, is necessary in connection to the separate antenna elements. This is because the steering of the antenna pattern of the antenna arrangement is by the present teaching achieved by phase control alone, as opposed to both phase and amplitude control.

Also, a network node implementing the method of FIG. 10 can achieve a high total output power, again due to that no explicit power attenuation is necessary in connection to the antenna elements of the present antenna arrangement.

According to some aspects, the method further comprises the step of generating S11*a* a first control signal from a pre-stored list of at least one selectable antenna pattern having respective stored first control signals, the generated first control signal is arranged to steer the phase shifts of each of the steerable phase shifters 211, 511.

According to aspects, the method also comprises the steps of generating S11*b* a second control signal from a pre-stored list of selectable antenna patterns having respective stored second control signals, and also configuring S13 a signal processing unit 522 having a main port 523 to receive a main antenna signal on the main port 523 and to transmit the main antenna signal to each of the E antenna arrangement ports 513 with a respective phase shift determined by the second control signal.

There is further comprises herein a computer program comprising computer program code which, when executed in a network node, causes the network node 102 to execute the method disclosed herein.

Figure 11:
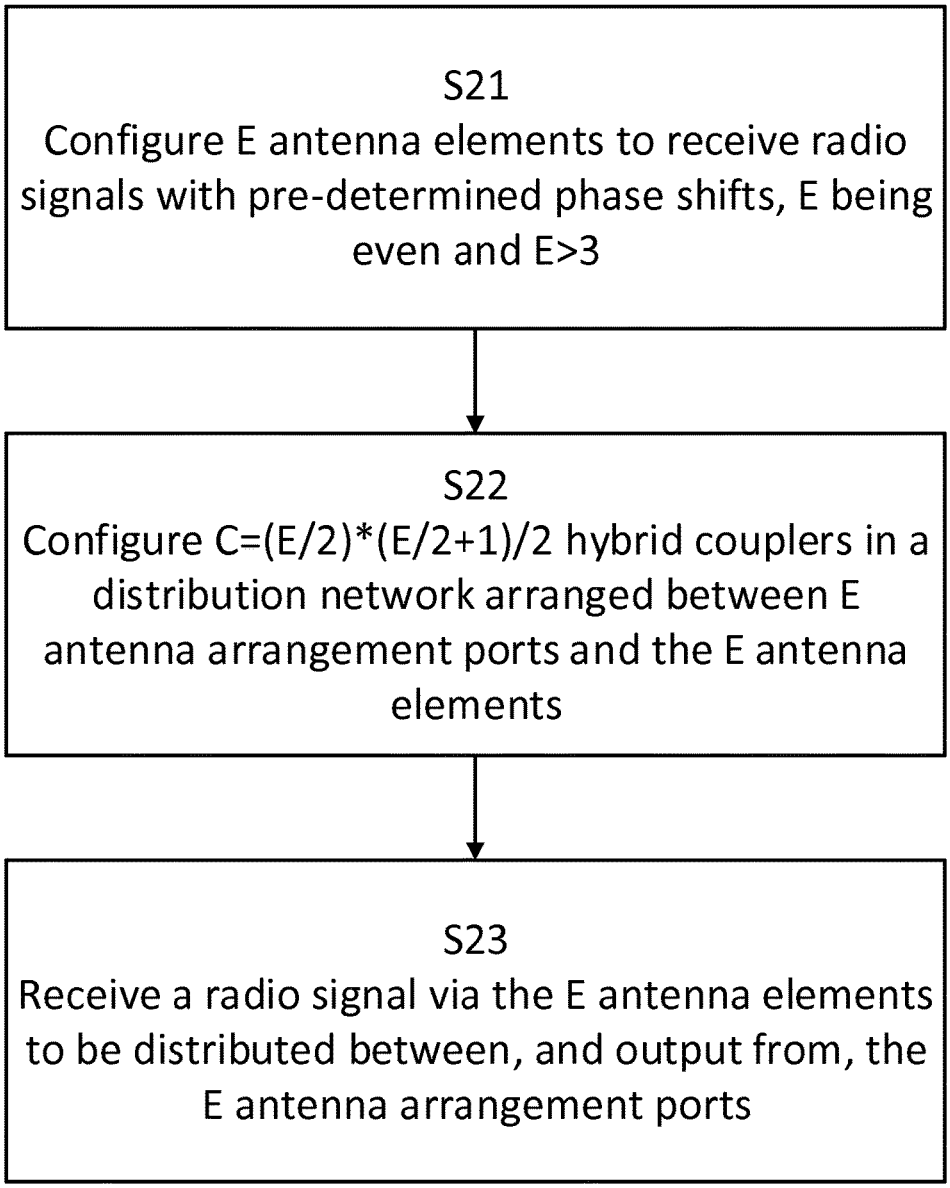

FIG. 11 shows a flowchart illustrating a method in a network node 102 for receiving radio signals via an antenna arrangement 100*a*, 200*b-f*. The method comprises configuring S21 a first antenna element 210' to receive and output a radio signal with a fixed phase shift, and E−1 steerable phase shift antenna elements 210 to receive and output respective radio signals having respective pre-determined phase shifts. The phase shifts are determined by E−1 respective steerable phase shifters 511, E being even and E>3.

The method also comprises configuring S22 a number of C=(E/2)*(E/2+1)/2 hybrid couplers 212 in a pyramid distribution network arranged between E antenna arrangement ports 213 and the E antenna elements 210', 210. The distribution network is operable to distribute a radio signal received via the E antenna elements between antenna arrangement ports.

The method also comprises receiving S23 a radio signal via the E antenna elements 210', 210 to be distributed by the pyramid distribution network between, and output from, the E antenna arrangement ports 213.

As for the method shown in FIG. 10, there is further disclosed herein a computer program comprising computer program code which, when executed in a network node, causes the network node 102 to execute the method disclosed herein.

Figure 12:
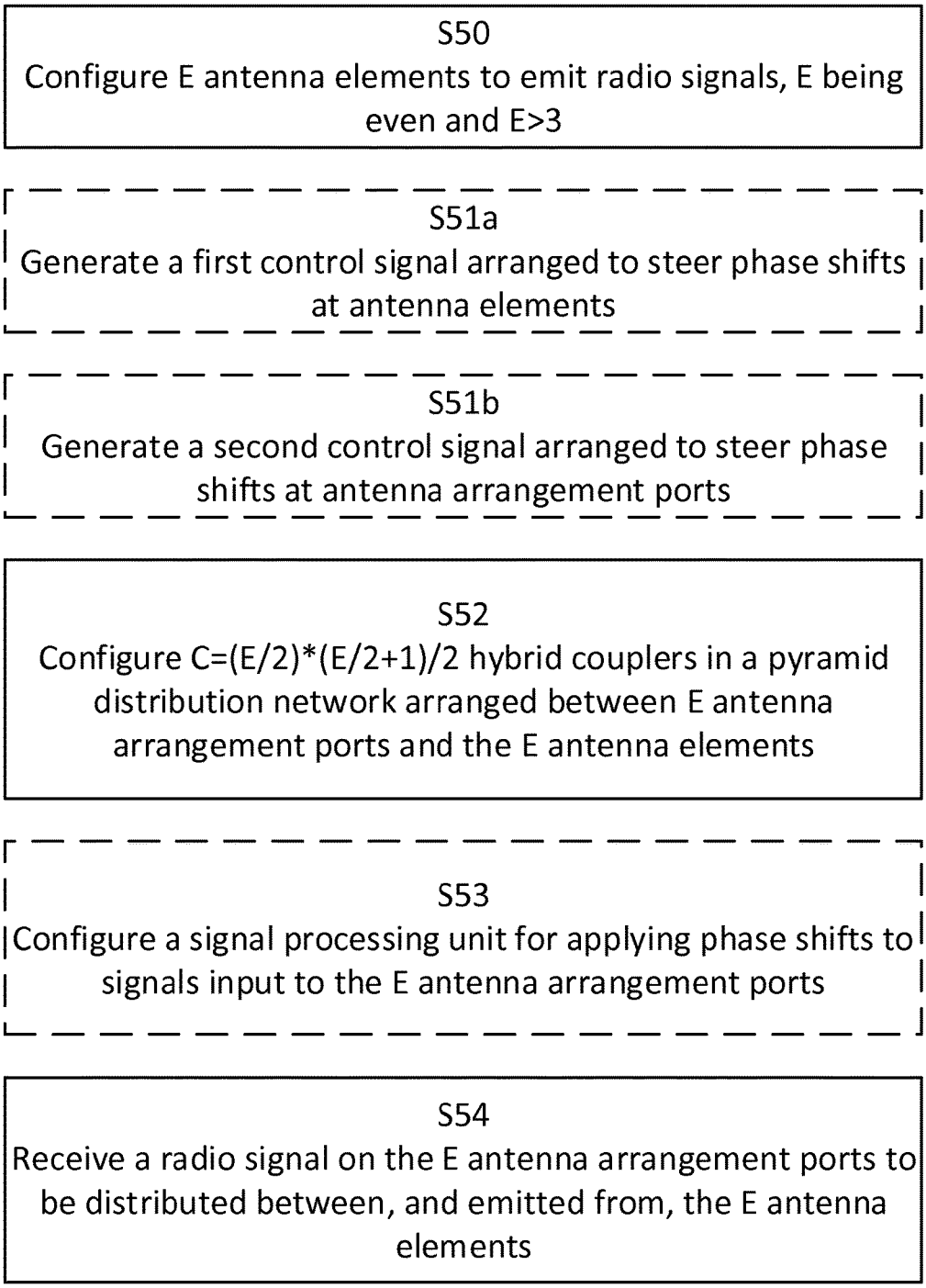
FIG. 12 shows embodiments of a network node.

FIG. 12 shows a network node arranged for transmitting radio signals via an antenna arrangement. The network node comprises a first module (S50) adapted to configure a first antenna element (210') to emit a radio signal with a fixed phase shift, and a number of E−1 steerable phase shift antenna elements (210) to emit respective radio signals having respective phase shifts, the phase shifts being determined by E−1 respective steerable phase shifters (511), E being even and E>3. The network node also comprises an optional second module (S51*a*) configured to generate a first control signal from a pre-stored list of at least one selectable antenna pattern having respective stored first control signals, the generated first control signal being arranged to steer the phase shifts of each of the steerable phase shifters (511), as well as an optional third module (S51*b*) configured to generate a second control signal from a pre-stored list of selectable antenna patterns having respective stored second control signals. The network node further comprises a fourth module (S52) adapted to configure a number of C=(E/2)*(E/2+1)/2 hybrid couplers (212) in a pyramid distribution network arranged between E antenna arrangement ports (213) and the E antenna elements (210', 210), the distribution network being operable to distribute a radio signal transmitted on the E antenna arrangement ports (213) between antenna elements (210', 210) based on relative signal phase at the antenna ports (213), and an optional fifth module (S53) adapted to configure a signal processing unit (522) having a main port (523) to receive a main antenna signal on the main port (523) and to transmit the main antenna signal to each of the E antenna arrangement ports (513) with a respective phase shift determined by the second control signal, as well as a sixth module (S54) configured to receive a radio signal on the E antenna arrangement ports (213), the radio signal having a respective and pre-determined signal phase on each of the E antenna arrangement ports.

The various example embodiments described herein are described in the general context of method steps or processes, which may be implemented in one aspect by a computer program product, embodied in a computer-readable medium, including computer-executable instructions, such as program code, executed by computers in networked environments. A computer-readable medium may include removable and non-removable storage devices including, but not limited to, Read Only Memory (ROM), Random Access Memory (RAM), compact discs (CDs), digital versatile discs (DVD), etc. Generally, program modules may include routines, programs, objects, components, data structures, etc. that perform particular tasks or implement particular abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps or processes.

The invention claimed is:

1. An antenna arrangement comprising a group of E number of antenna elements, the group of comprising a first, second, third and fourth antenna element, each of the second, third and fourth antenna elements being connected to a respective steerable phase shifter such that the second antenna element is connected to a first steerable phase shifter, the third antenna element is connected to a second steerable phase shifter, and the fourth antenna element is connected to a fourth steerable phase shifter, but the first antenna element is not connected to a steerable phase shifter, a number C=(E/2)*(E/2+1)/2 of hybrid couplers stacked in E/2 tiers of a pyramid distribution network, wherein a bottommost tier comprises E/2 hybrid couplers and each of at least one overlaying tier comprises one less hybrid coupler than a tier immediately below, each of the hybrid couplers being configured with first, second, third, and fourth ports configured to have a single connection, and a number of E antenna arrangement ports configured as an interface to the antenna arrangement, wherein the first and second hybrid coupler ports of the bottommost tier of hybrid couplers are connected to a respective antenna arrangement port, and each of the first and second ports of hybrid couplers in the overlaying at least one tier being connected to respective third or fourth ports of hybrid couplers in the tier immediately below, such that each hybrid coupler in the overlaying at least one tier is connected to two different hybrid couplers in the tier immediately below, wherein remaining unconnected third or fourth hybrid coupler ports being connected directly to the first antenna element or to one of the other antenna elements via the corresponding phase shifter such that each antenna element is connected directly or indirectly via a phase shifter to a single hybrid coupler port.

2. The antenna arrangement according to claim 1, further comprising a phase steering input port configured to receive a first control signal arranged to individually steer the phases of the steerable phase shifters.

3. The antenna arrangement according to claim 2, further comprising a signal processing unit having a main port configured to pass a main antenna signal, and a control port configured to receive a second control signal, the signal processing unit being arranged to pass the main antenna signal to each of the E antenna arrangement ports with individual phase shifts determined by the second control signal.

4. The antenna arrangement according to claim 3, wherein the signal processing unit comprises a number of E−1 steerable phase shifters, each connected to a respective antenna arrangement port, wherein the steerable phase shifters are arranged to be individually steered by the second control signal, and a signal splitter arranged to distribute the main antenna signal between the main port and E−1 antenna arrangement ports via the steerable phase shifters, and also between the main port and a first antenna arrangement port having no associated steerable phase shifter.

5. The antenna arrangement according to claim 3, further comprising a control unit configured to generate the first and the second control signal from at least one pre-configured antenna pattern having pre-determined corresponding first and second control signals, the control unit being arranged to pass the generated first and second control signals to the phase steering input port and to the control port of the signal processing unit, respectively.

6. The antenna arrangement according to claim 5, wherein the control unit comprises a memory module configured to store list of at least one selectable antenna pattern, each of the at least one selectable antenna pattern having an associated first and second control signal stored in the memory module.

7. The antenna arrangement according to claim 2, further comprising a base station unit arranged to:

transmit radio signals via the E antenna arrangement ports, wherein each such transmitted radio signal is an envelope replica of a common transmit signal, wherein each such transmitted radio signal has a pre-determined individual phase, and generate the first control signal, and to pass the first control signal to the phase steering input port for steering of the steerable phase shifters.

8. The antenna arrangement according to claim 7, the base station unit comprising a memory module having a stored list of at least one selectable antenna pattern, each of the at least one selectable antenna pattern having an associated first control signal stored in the memory module, and also a corresponding pre-determined phase for each of the transmitted radio signals.

9. A network node comprising the antenna arrangement according to claim 1.

10. A method in a network node for transmitting radio signals via an antenna arrangement, the method comprising configuring a first antenna element to emit a radio signal with a fixed phase shift, and a number of E−1 steerable phase shift antenna elements to emit respective radio signals having respective phase shifts, the phase shifts being determined by E−1 respective steerable phase shifters, E being even and E>3, configuring a number of C=E/2)*(E/2+1)/2 hybrid couplers in a pyramid distribution network arranged between E antenna arrangement ports and the E antenna elements, the distribution network being operable to distribute a radio signal transmitted on the E antenna arrangement ports between antenna elements based on relative signal phase at the antenna ports, and receiving a radio signal on the E antenna arrangement ports, the radio signal having a respective and pre-determined signal phase on each of the E antenna arrangement ports.

11. The method according to claim 10, further comprising the step of:

generating a first control signal from a pre-stored list of at least one selectable antenna pattern having respective stored first control signals, the generated first control signal being arranged to steer the phase shifts of each of the steerable phase shifters.

12. The method according to claim 11, further comprising the steps of:

generating a second control signal from a pre-stored list of selectable antenna patterns having respective stored second control signals, and configuring a signal processing unit having a main port to receive a main antenna signal on the main port and to transmit the main antenna signal to each of the E antenna arrangement ports with a respective phase shift determined by the second control signal.

13. A computer program product comprising a non-transitory computer readable medium comprising a computer program comprising computer program code which, when executed in a network node, causes the network node to execute the method according to claim 10.

14. A method in a network node for receiving radio signals via an antenna arrangement, the method comprising configuring a first antenna element to receive and output a radio signal with a fixed phase shift, and E−1 steerable phase shift antenna elements to receive and output respective radio signals having respective pre-determined phase shifts, the phase shifts being determined by E−1 respective steerable phase shifters, E being even and E>3, configuring C=(E/2)*(E/2+1)/2 hybrid couplers in a pyramid distribution network arranged between E antenna arrangement ports and the E antenna elements, the distribution network being operable to distribute a radio signal received via the E antenna elements between antenna arrangement ports, receiving a radio signal via the E antenna elements to be distributed by the pyramid distribution network between, and output from, the E antenna arrangement ports.

15. A computer program product comprising a non-transitory computer readable medium comprising a computer program comprising computer program code which, when executed in a network node, causes the network node to execute the method according to claim 14.

16. A network node arranged for transmitting radio signals via an antenna arrangement, the network node being adapted to:

configure a first antenna element to emit a radio signal with a fixed phase shift, configure a number of E−1 steerable phase shift antenna elements to emit respective radio signals having respective phase shifts, the phase shifts being determined by E−1 respective steerable phase shifters, E being even and E>3, configure a number of C=(E/2)*(E/2+1)/2 hybrid couplers in a pyramid distribution network arranged between E antenna arrangement ports and the E antenna elements, the distribution network being operable to distribute a radio signal transmitted on the E antenna arrangement ports between antenna elements based on relative signal phase at the antenna ports, and receive a radio signal on the E antenna arrangement ports, the radio signal having a respective and pre-determined signal phase on each of the E antenna arrangement ports.

17. The network node of claim 16, wherein the network node is further adapted to:

generate a first control signal from a pre-stored list of at least one selectable antenna pattern having respective stored first control signals, the generated first control signal being arranged to steer the phase shifts of each of the steerable phase shifters, generate a second control signal from a pre-stored list of selectable antenna patterns having respective stored second control signals, and configure a signal processing unit having a main port to receive a main antenna signal on the main port and to transmit the main antenna signal to each of the E antenna arrangement ports with a respective phase shift determined by the second control signal.

* * * * *